US005682766A

United States Patent [19]

Bonaquist et al.

[11] Patent Number: 5,682,766

[45] Date of Patent: Nov. 4, 1997

[54] CRYOGENIC RECTIFICATION SYSTEM FOR PRODUCING LOWER PURITY OXYGEN AND HIGHER PURITY OXYGEN

[75] Inventors: Dante Patrick Bonaquist, Grand Island; Nancy Jean Lynch, Tonawanda, both of N.Y.

[73] Assignee: Praxair Technology, Inc., Danbury, Conn.

[21] Appl. No.: 764,431

[22] Filed: Dec. 12, 1996

[51] Int. Cl.[6] ..... F25J 3/02

[52] U.S. Cl. ..... 62/646; 62/654

[58] Field of Search ..... 62/646, 654

[56] References Cited

U.S. PATENT DOCUMENTS

| | | | |
|---|---|---|---|
| 5,315,833 | 5/1994 | Ha et al. | 62/38 |
| 5,337,570 | 8/1994 | Prosser | 62/25 |
| 5,349,824 | 9/1994 | Ha et al. | 62/24 |
| 5,386,691 | 2/1995 | Bonaquist et al. | 62/646 |
| 5,396,773 | 3/1995 | Ha et al. | 62/39 |
| 5,463,871 | 11/1995 | Cheung | 62/38 |
| 5,469,710 | 11/1995 | Howard et al. | 62/646 |
| 5,490,391 | 2/1996 | Hogg et al. | 62/646 |
| 5,546,767 | 8/1996 | Dray et al. | 62/646 |

*Primary Examiner*—Ronald C. Capossela
*Attorney, Agent, or Firm*—Stanley Ktorides

[57] ABSTRACT

A cryogenic rectification system having high recovery of both higher purity and lower purity oxygen which employs a side column having a bottom reboiler wherein feed air is partially condensed and the feed air vapor remaining after the partial condensation is turboexpanded prior to rectification.

10 Claims, 3 Drawing Sheets

CRYOGENIC RECTIFICATION SYSTEM FOR PRODUCING LOWER PURITY OXYGEN AND HIGHER PURITY OXYGEN

TECHNICAL FIELD

This invention relates generally to the cryogenic rectification of feed air and, more particularly, to the cryogenic rectification of feed air to produce lower purity oxygen and higher purity oxygen.

BACKGROUND ART

The demand for lower purity oxygen is increasing in applications such as glassmaking, steelmaking and energy production. Lower purity oxygen is generally produced in large quantities by the cryogenic rectification of feed air in a double column wherein feed air at the pressure of the higher pressure column is used to reboil the liquid bottoms of the lower pressure column and is then passed into the higher pressure column.

Some users of lower purity oxygen, for example integrated steel mills, often require some higher purity oxygen in addition to lower purity gaseous oxygen. While it has long been possible to produce some higher purity oxygen along with lower purity oxygen, conventional systems cannot effectively produce significant quantities of higher purity oxygen along with lower purity oxygen.

Accordingly it is an object of this invention to provide a cryogenic rectification system which can effectively produce both lower purity oxygen and higher purity oxygen with high recovery.

Sometimes it is desirable to recover argon along with lower purity oxygen and higher purity oxygen. Accordingly, it is another object of this invention to provide a cryogenic rectification system which can produce argon in addition to lower purity oxygen and higher purity oxygen.

In addition, it is sometimes desirable to produce liquid nitrogen along with lower purity oxygen and higher purity oxygen. Accordingly, it is a further object of this invention to provide a cryogenic rectification system which can produce liquid nitrogen in addition to lower purity oxygen and higher purity oxygen.

SUMMARY OF THE INVENTION

The above and other objects, which will become apparent to one skilled in the art upon a reading of this disclosure, are attained by the present invention, one aspect of which is:

A method for producing lower purity oxygen and higher purity oxygen comprising:

(A) partially condensing feed air by indirect heat exchange with higher purity oxygen to produce liquid feed air and gaseous feed air;

(B) turboexpanding the gaseous feed air and passing the turboexpanded gaseous feed air into a medium pressure column;

(C) separating feed air within the medium pressure column by cryogenic rectification to produce nitrogen-enriched fluid and oxygen-enriched fluid, and passing nitrogen-enriched fluid and oxygen-enriched fluid into a lower pressure column;

(D) producing nitrogen-richer fluid and oxygen-richer fluid by cryogenic rectification within the lower pressure column, and passing oxygen-richer fluid from the lower pressure column into a side column; and (E) separating oxygen-richer fluid by cryogenic rectification within the side column into lower purity oxygen and said higher purity oxygen, recovering lower purity oxygen from the side column and recovering higher purity oxygen from the side column.

Another aspect of the invention is:

Apparatus for producing lower purity oxygen and higher purity oxygen comprising:

(A) a first column, a second column, and a side column having a reboiler;

(B) a turboexpander, means for passing feed air into the side column reboiler, and means for passing feed air from the side column reboiler into the turboexpander;

(C) means for passing feed air from the turboexpander into the first column, and means for passing fluid from the first column into the second column;

(D) means for passing fluid from the second column into the side column; and (E) means for recovering higher purity oxygen from the side column, and means for recovering lower purity oxygen from the side column above the level from which higher purity oxygen is recovered from the side column.

As used herein, the term "feed air" means a mixture comprising primarily oxygen, nitrogen and argon, such as ambient air.

As used herein, the term "column" means a distillation or fractionation column or zone, i.e. a contacting column or zone, wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, *The Continuous Distillation Process.*

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is generally adiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein, the term "indirect heat exchange" means the bringing of two fluid streams into heat exchange relation without any physical contact or intermixing of the fluids with each other.

As used herein, the term "reboiler" means a heat exchange device that generates column upflow vapor from column liquid. A reboiler may be located within or outside of the column. A bottom reboiler is a reboiler which vaporizes liquid from the bottom of the column, i.e. from below the mass transfer elements.

As used herein, the terms "turboexpansion" and "turboexpander" mean respectively method and apparatus for the flow of high pressure gas through a turbine to reduce the pressure and the temperature of the gas thereby generating refrigeration.

As used herein, the terms "upper portion" and "lower portion" mean those sections of a column respectively above and below the midpoint of the column.

As used herein, the term "tray" means a contacting stage, which is not necessarily an equilibrium stage, and may mean other contacting apparatus such as packing having a separation capability equivalent to one tray.

As used herein, the term "equilibrium stage" means a vapor-liquid contacting stage whereby the vapor and liquid leaving the stage are in mass transfer equilibrium, e.g. a tray having 100 percent efficiency or a packing element height equivalent to one theoretical plate (HETP).

As used herein, the term "lower purity oxygen" means a fluid having an oxygen concentration within the range of from 50 to 98 mole percent.

As used herein, the term "higher purity oxygen" means a fluid having an oxygen concentration greater than 98 mole percent.

As used herein, the term "argon column" means a column which processes a feed comprising argon and produces a product having an argon concentration which exceeds that of the feed.

DETAILED DESCRIPTION

Figure 1:
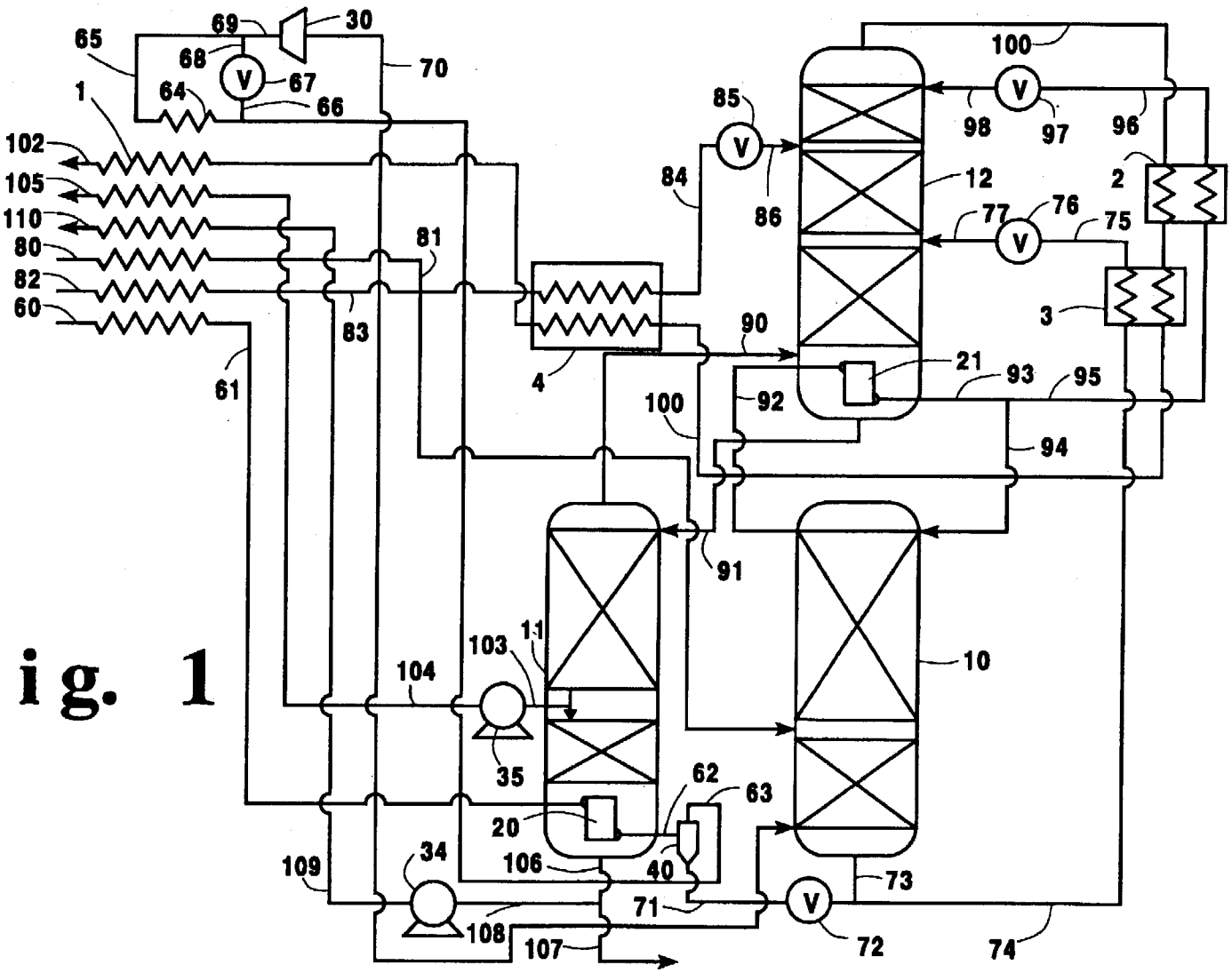
FIG. 1 is a schematic representation of one preferred embodiment of the invention.

The invention will be described in detail with reference to the Drawings. Referring now to FIG. 1, feed air 60, which has been cleaned of high boiling impurities such as water vapor, carbon dioxide and hydrocarbons, and which has been compressed to a pressure generally within the range of from 50 to 60 pounds per square inch absolute (psia), is cooled by indirect heat exchange with return streams by passage through main heat exchanger 1. Resulting cooled feed air stream 61 is passed into bottom reboiler 20 of side column 11 wherein it is partially condensed by indirect heat exchange with side column 11 bottom liquid which comprises higher purity oxygen. The partial condensation of the feed air in bottom reboiler 20 produces liquid feed air and remaining gaseous feed air which are passed in two-phase stream 62 into phase separator 40.

Gaseous feed air resulting from the partial condensation of the feed air in bottom reboiler 20 is turboexpanded and then passed into the lower portion of first or medium pressure column 10. The embodiment of the invention illustrated in FIG. 1 is a preferred embodiment wherein this gaseous feed air is superheated, at least in part, prior to the turboexpansion. Referring back now to FIG. 1, gaseous feed air resulting from the partial condensation of feed air in bottom reboiler 20 is passed out from phase separator 40 in stream 63. A first portion 64 of stream 63 is heated by partial traverse of main heat exchanger 1 to form heated stream 65. A second portion 66 of stream 63 is passed through valve 67 and resulting stream 68 is combined with stream 65 to form stream 69 which is turboexpanded to generate refrigeration by passage through turboexpander 30 to about the operating pressure of medium pressure column 10. Resulting turboexpanded feed air stream 70 is passed from turboexpander 30 into the lower portion of medium pressure column 10. A second feed air stream 80, which has been cleaned of high boiling impurities and compressed to a pressure within the range of from 120 to 500 psia, is cooled by passage through main heat exchanger 1 and resulting cooled feed air stream 81 is also passed into medium pressure column 10.

Medium pressure column 10 is operating at a pressure generally within the range of from 30 to 40 psia and below the operating pressure of a conventional higher pressure column of a double column system. Within medium pressure column 10 the feed air is separated by cryogenic rectification into nitrogen-enriched vapor and oxygen-enriched liquid. Nitrogen-enriched vapor is passed from the upper portion of medium pressure column 10 in stream 92 into bottom reboiler 21 of lower pressure column 12 wherein it is condensed by indirect heat exchange with lower pressure column 12 bottom liquid. Resulting nitrogen-enriched liquid 93 is divided into first portion 94, which is passed into the upper portion of column 10 as reflux, and into second portion 95, which is subcooled by passage through subcooler or heat exchanger 2. Subcooled stream 96 is passed through valve 97 and then passed in stream 98 as reflux into the upper portion of lower pressure column 12.

Liquid feed air resulting from the partial condensation of feed air in bottom reboiler 20 is passed into lower pressure column 12. Oxygen-enriched liquid is passed from the lower portion of medium pressure column 10 into lower pressure column 12. The embodiment of the invention illustrated in FIG. 1 is a preferred embodiment wherein these two liquids are combined and passed into the lower pressure column. Referring back to FIG. 1, liquid feed air resulting from the partial condensation of feed air in bottom reboiler 20 is withdrawn from phase separator 40 as stream 71 and passed through valve 72. Oxygen-enriched liquid is withdrawn from the lower portion of medium pressure column 10 in stream 73 which is combined with stream 71 to form stream 74. Stream 74 is subcooled by passage through subcooler 3 and resulting stream 75 is passed through valve 76 and then as stream 77 into lower pressure column 12. A third feed air stream 82, which has been cleaned of high boiling impurities and compressed to a pressure within the range of from 50 to 60 psia is cooled by passage through main heat exchanger 1. Resulting stream 83 is further cooled by passage through heat exchanger 4 and resulting stream 84 is passed through valve 85 and then as stream 86 into the upper portion of lower pressure column 12.

Second or lower pressure column 12 is operating at a pressure less than that of medium pressure column 10 and generally within the range of from 18 to 22 psia. Within lower pressure column 12 the various feeds into the column are separated by cryogenic rectification into nitrogen-richer fluid and oxygen-richer fluid. Nitrogen-richer fluid is withdrawn from the upper portion of lower pressure column 12 as stream 100, warmed by passage through heat exchangers 2, 3, 4 and 1 and removed from the system in stream 102 which may be recovered in whole or in part as product nitrogen gas having a nitrogen concentration of 99 mole percent or more. Oxygen-richer fluid is withdrawn from the lower portion of lower pressure column 12 in liquid stream 91 and passed into the upper portion of side column 11.

Side column 11 is operating at a pressure generally within the range of from 18 to 22 psia. Oxygen-richer fluid is separated by cryogenic rectification within side column 11 into lower purity oxygen and higher purity oxygen. A top vapor stream 90 is passed from the upper portion of side column 11 into the lower portion of lower pressure column 12.

Either or both of the lower purity oxygen and the higher purity oxygen may be withdrawn from side column 11 as liquid or vapor for recovery. Higher purity oxygen collects as liquid at the bottom of side column 11 and some of this liquid is vaporized to carry out the aforedescribed partial condensation of the feed air in bottom reboiler 20. In the embodiment of the invention illustrated in FIG. 1, higher purity oxygen is withdrawn as liquid from side column 11 in stream 106 and a portion 107 of stream 106 is recovered as product liquid higher purity oxygen. Another portion 108 of stream 106 is pumped to a higher pressure by passage through liquid pump 34 and resulting pressurized stream 109 is vaporized by passage through main heat exchanger 1 and recovered as product elevated pressure higher purity oxygen gas in stream 110.

Lower purity oxygen is withdrawn from side column 11 at a level from 15 to 25 equilibrium stages above level from which higher purity oxygen is withdrawn from side column 11. In the embodiment of the invention illustrated in FIG. 1 lower purity oxygen is withdrawn from side column 11 as liquid in stream 103 and pumped to a higher pressure by passage through liquid pump 35. Pressurized stream 104 is vaporized by passage through main heat exchanger 1 and recovered as product elevated pressure lower purity oxygen gas in stream 105.

With the practice of this invention large quantities of higher purity oxygen may be recovered in addition to lower purity oxygen. Generally with the practice of this invention, the quantity of higher purity oxygen recovered in gaseous and/or liquid form will be from 0.5 to 1.0 times the quantity of lower purity oxygen recovered in gaseous and/or liquid form.

The production of significant quantities of higher purity oxygen is enabled by the withdrawal of lower purity liquid oxygen from a point above the base of column 11. The withdrawal of this oxygen decreases the quantity of liquid (L) descending below that point compared to the quantity of vapor (V) rising within the column from reboiler 20 located at its base. The purity which can be achieved for the liquid oxygen stream 106 taken from the base of column 11 is limited by the ratio of L to V within column 11 below the point where stream 103 is removed; the greater this ratio, the more impure stream 106 will be. By virtue of withdrawing stream 103, the production of higher purity oxygen from the base of column 11 is facilitated due to the resulting decrease in the L to V ratio. Furthermore, the production of higher purity oxygen is enabled by removing argon entering the process as a constituent of the feed air. Argon tends to accumulate in the liquid descending within column 11. Normally, the buildup of argon in the liquid makes the production of higher purity oxygen difficult. However, since stream 103 contains a large portion of the argon entering the plant in the feed air, the buildup of argon is in the column below the stream 103 withdrawal point is reduced.

Figure 2:
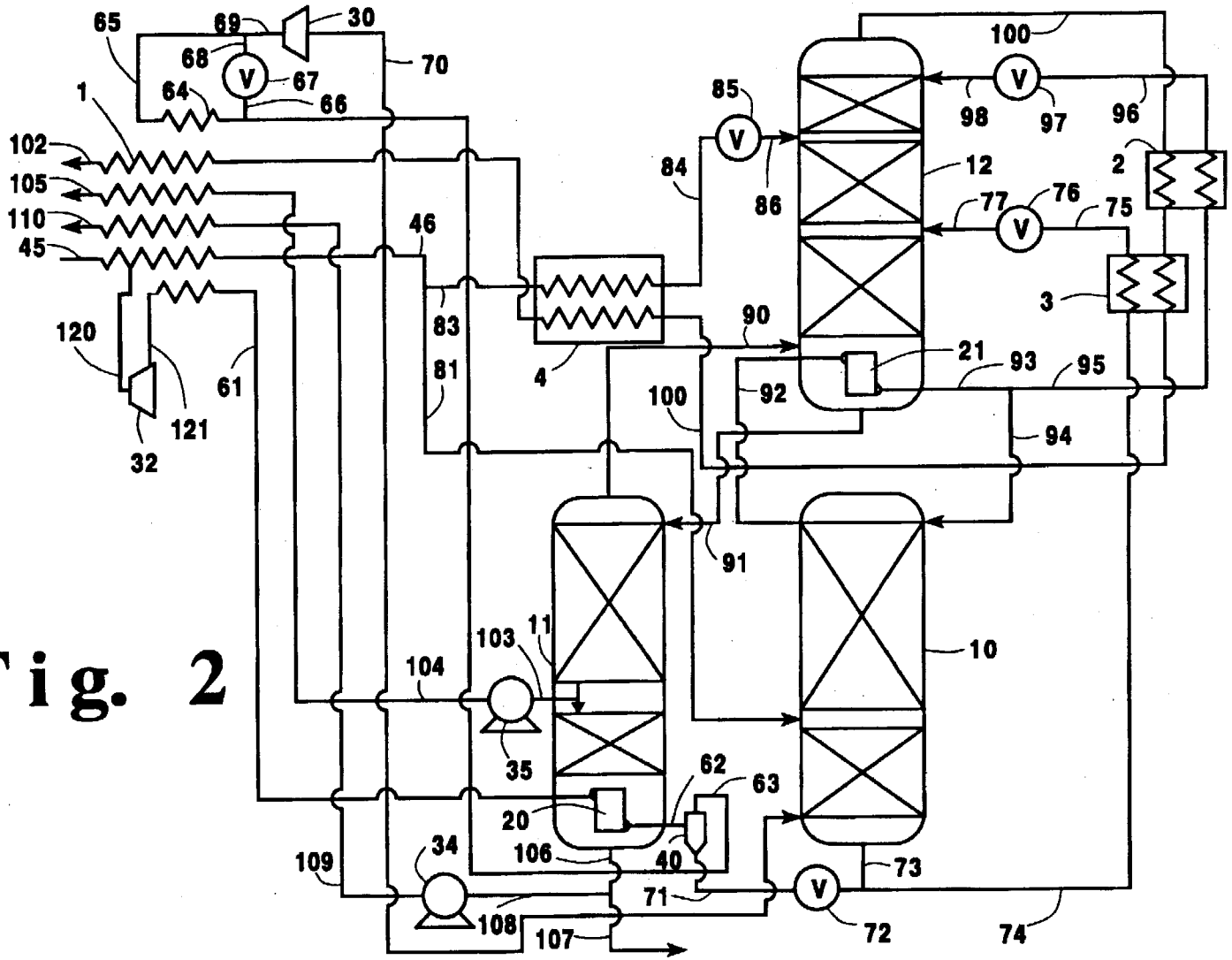
FIG. 2 is a schematic representation of a preferred embodiment of the invention wherein liquid nitrogen may also be produced.

FIG. 2 illustrates another embodiment of the invention wherein liquid nitrogen as well as larger quantities of liquid higher purity oxygen may be produced. The numerals in FIG. 2 correspond to those of FIG. 1 for the common elements and these common elements will not be discussed again in detail.

Referring now to FIG. 2, all of the feed air, which has been cleaned of high boiling impurities, is compressed to a higher pressure generally within the range of from 80 to 1000 psia. Feed air stream 45 is passed into main heat exchanger 1 and a portion 120 is withdrawn after partial traversed of main heat exchanger 1. The remaining portion 46 passes completely through main heat exchanger 1 and is divided into streams 82 and 83 which are processed as previously described with respect to the embodiment illustrated in FIG. 1. Portion 120 is passed to turboexpander 32 wherein it is turboexpanded to a pressure similar to that of feed air stream 60 of the embodiment illustrated in FIG. 1. Turboexpanded stream 121 is passed from turboexpander 32 back into main heat exchanger 1 from which it emerges as stream 61 which is processed as previously described. A portion 112 of nitrogen-enriched liquid stream 96 is passed through valve 113 and recovered as liquid nitrogen product 114 having a nitrogen concentration of 99 mole percent or more.

Figure 3:
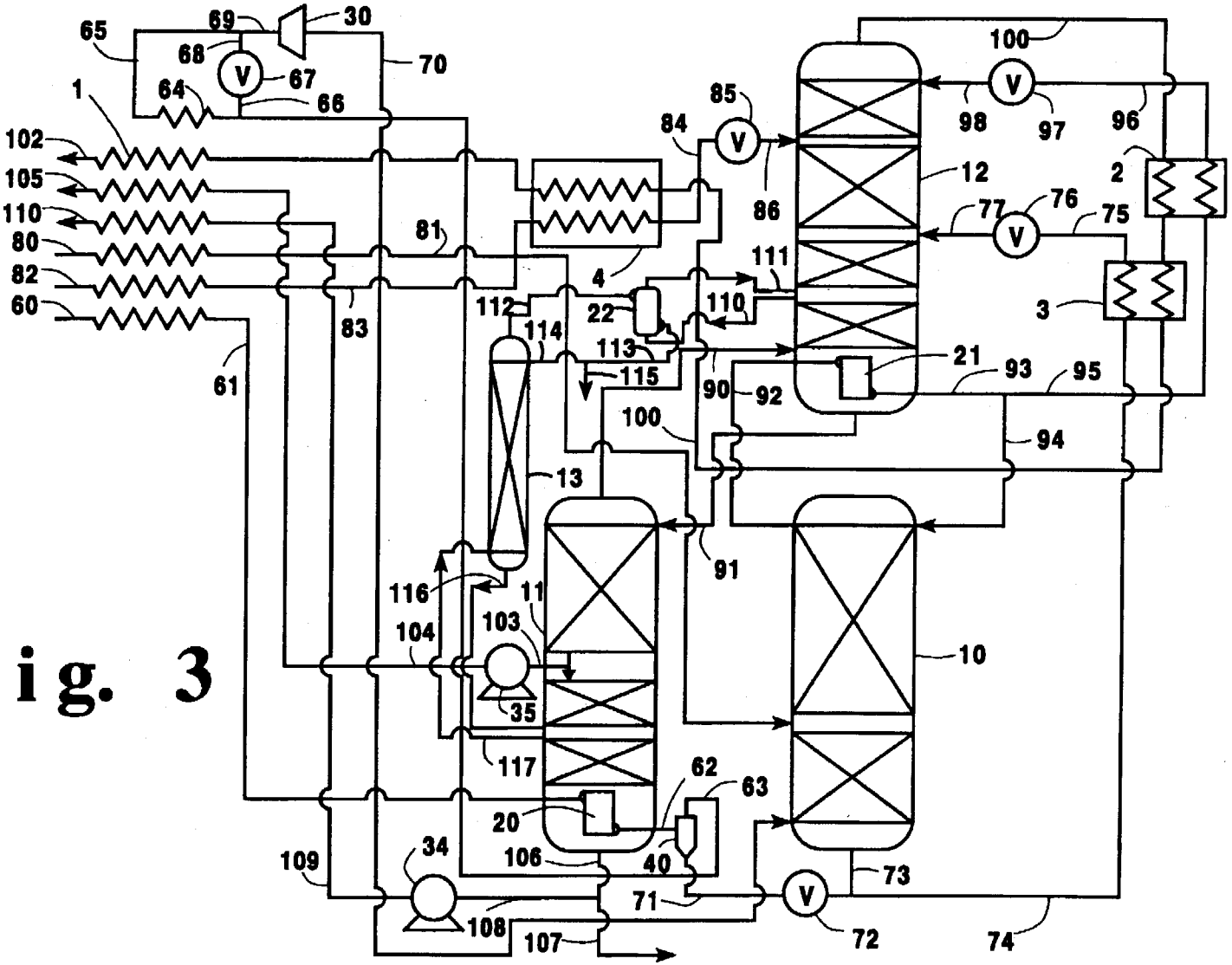
FIG. 3 is a schematic representation of a preferred embodiment of the invention wherein argon may also be produced.

FIG. 3 illustrates another embodiment of the invention wherein argon product is additionally produced. The numerals in FIG. 3 correspond to those of FIG. 1 for the common elements and these common elements will not be discussed again in detail.

Referring now to FIG. 3, stream 117 comprising primarily oxygen and argon is withdrawn from side column 11 at a level below that from which lower purity oxygen fluid is withdrawn in stream 103. The argon column feed stream 117 is passed into argon column 13 wherein it is separated by cryogenic rectification into argon-richer fluid and oxygen-rich fluid. The oxygen-rich fluid is passed from the lower portion of argon column 11 in stream 116 back into side column 11. Argon-richer fluid is recovered from the upper portion of argon column 13 as product argon having an argon concentration generally of from 95 to 100 mole percent. In the embodiment of invention illustrated in FIG. 3, the product argon is recovered as liquid. Referring to FIG. 3, argon-richer vapor is withdrawn from the upper portion of argon column 13 in stream 112 and passed into condenser or reboiler 22 wherein it is condensed. Resulting condensed argon-richer liquid is withdrawn from condenser 22 in stream 113 and is divided into first portion 114, which is passed into argon column 13 as reflux, and into second portion 115 which is recovered as product argon. Condenser 22 is driven by fluid from lower pressure column 12. A liquid stream 110 is withdrawn from lower pressure column 12 from a level 4 to 10 equilibrium stages above reboiler 21 and passed into condenser 22 wherein it is vaporized by indirect heat exchange with the condensing argon-richer vapor. Resulting vapor is returned to lower pressure column 12 in stream 111. The heat exchange carried out in condenser 22 alternatively may be carried out in a reboiler within lower pressure column 12 located at about the level from which stream 11 would have been withdrawn. Alternatively the argon-richer vapor may be condensed by indirect heat exchange with oxygen-enriched fluid taken from the medium pressure column.

Although the invention has been described in detail with reference to certain preferred embodiments, those skilled in the art will recognize that there are other embodiments of the invention within the spirit and the scope of the claims.

We claim:

1. A method for producing lower purity oxygen and higher purity oxygen comprising:

(A) partially condensing feed air by indirect heat exchange with higher purity oxygen to produce liquid feed air and gaseous feed air;

(B) turboexpanding the gaseous feed air and passing the turboexpanded gaseous feed air into a medium pressure column;

(C) separating feed air within the medium pressure column by cryogenic rectification to produce nitrogen-enriched fluid and oxygen-enriched fluid, and passing nitrogen-enriched fluid and oxygen-enriched fluid into a lower pressure column;

(D) producing nitrogen-richer fluid and oxygen-richer fluid by cryogenic rectification within the lower pressure column, and passing oxygen-richer fluid from the lower pressure column into a side column; and (E) separating oxygen-richer fluid by cryogenic rectification within the side column into lower purity oxygen and said higher purity oxygen, recovering lower purity oxygen from the side column and recovering higher purity oxygen from the side column.

2. The method of claim 1 wherein the feed air is turboexpanded prior to said partial condensation.

3. The method of claim 2 wherein a portion of the nitrogen-enriched fluid is recovered as product nitrogen.

4. The method of claim 1 further comprising passing argon-containing fluid from the side column into an argon column, producing argon-richer fluid by cryogenic rectification within the argon column, and recovering argon-richer fluid from the argon column as product argon.

5. The method of claim 4 wherein vapor from the upper portion of the argon column is condensed by indirect heat exchange with fluid from at least one of the lower pressure column and the medium pressure column.

6. The method of claim 1 further comprising passing liquid feed air, produced by the partial condensation of feed air by indirect heat exchange with higher purity oxygen, into the lower pressure column.

7. Apparatus for producing lower purity oxygen and higher purity oxygen comprising:

(A) a first column, a second column, and a side column having a reboiler;

(B) a turboexpander, means for passing feed air into the side column reboiler, and means for passing feed air from the side column reboiler into the turboexpander;

(C) means for passing feed air from the turboexpander into the first column, and means for passing fluid from the first column into the second column;

(D) means for passing fluid from the second column into the side column; and (E) means for recovering higher purity oxygen from the side column, and means for recovering lower purity oxygen from the side column above the level from which higher purity oxygen is recovered from the side column.

8. The apparatus of claim 7 wherein the means for passing feed air into the side column reboiler includes a turboexpander.

9. The apparatus of claim 7 further comprising an argon column, means for passing fluid from the side column into the argon column and means for recovering argon product from the upper portion of the argon column.

10. The apparatus of claim 9 further comprising a heat exchanger in flow communication with the upper portion of the argon column and with the second column from 4 to 10 equilibrium stages above the bottom of the second column.

* * * * *